US008580360B2

(12) United States Patent
Yasumatsu

(10) Patent No.: US 8,580,360 B2
(45) Date of Patent: Nov. 12, 2013

(54) THERMAL TRANSFER SHEET AND INK RIBBON

(75) Inventor: Ryo Yasumatsu, Kanagawa (JP)

(73) Assignee: Sony Corporation, Tokyo (JP)

( * ) Notice: Subject to any disclaimer, the term of this patent is extended or adjusted under 35 U.S.C. 154(b) by 300 days.

(21) Appl. No.: 12/769,826

(22) Filed: Apr. 29, 2010

(65) Prior Publication Data

US 2010/0291326 A1 Nov. 18, 2010

(30) Foreign Application Priority Data

May 15, 2009 (JP) ..... 2009-118163

(51) Int. Cl.

| | |
|---|---|
| ***B41M 5/40*** | (2006.01) |
| ***B41M 5/42*** | (2006.01) |
| ***B41M 5/44*** | (2006.01) |
| ***B41M 5/385*** | (2006.01) |

(52) U.S. Cl.

CPC . *B41M 5/42* (2013.01); *B41M 5/44* (2013.01); *B41M 5/423* (2013.01); *B41M 5/385* (2013.01)

USPC ..... 428/32.69; 428/32.77; 428/32.79

(58) Field of Classification Search

CPC ..... B41M 5/42; B41M 5/44; B41M 5/423; B41M 5/385

USPC ..... 428/32.69, 32.77, 32.79

See application file for complete search history.

(56) References Cited

U.S. PATENT DOCUMENTS

| | | | | |
|---|---|---|---|---|
| 5,322,832 | A * | 6/1994 | Takeyama et al. | 503/227 |
| 5,612,281 | A * | 3/1997 | Kobayashi et al. | 428/32.11 |
| 2002/0197453 | A1* | 12/2002 | Usuki et al. | 428/195 |
| 2007/0031616 | A1* | 2/2007 | Sogabe et al. | 428/32.51 |

FOREIGN PATENT DOCUMENTS

| | | |
|---|---|---|
| JP | 07-117367 | 5/1995 |
| JP | 11-105438 | 4/1999 |
| JP | 2001-199162 | 7/2001 |
| JP | 2004-106501 | 4/2004 |
| JP | 2006-124686 | 5/2006 |

OTHER PUBLICATIONS

Japanese Office Action for Japanese counterpart JP application No. JP2009-118163 dated Mar. 19, 2013.

* cited by examiner

*Primary Examiner* — Betelhem Shewareged
(74) *Attorney, Agent, or Firm* — Dentons US LLP

(57) ABSTRACT

A thermal transfer sheet includes a protective layer and an adhesive layer which are laminated on a sheet base material in that order, the protective layer including a binder resin containing fine particles. The particle diameter of the fine particles is 0.9 to 2.8 times the thickness of the protective layer.

5 Claims, 1 Drawing Sheet r=0.9×t TO 2.8×t r=0.9×t TO 2.8×t

THERMAL TRANSFER SHEET AND INK RIBBON

BACKGROUND OF THE INVENTION

1. Field of the Invention

The present invention relates to a thermal transfer sheet and an ink ribbon, and particularly to a thermal transfer sheet being excellent in detachability between a non-transferable release layer and an image protecting layer and being capable of imparting a high glossy feel to prints.

2. Description of the Related Art

Protective layers composed of a thermoplastic resin are laminated on images formed on printing paper, for example, ink images formed by a sublimation thermal transfer method using sublimation or thermal diffusion dyes. The protective layers are imparted with gas cutoff performance and ultraviolet absorbing performance so that discoloration of images can be prevented, and transfer of inks which form images to various articles containing plasticizers, such as erasers and the like can be prevented.

A usual method for laminating a protective layer on an ink image is a method using a thermal transfer sheet. The thermal transfer sheet is prepared by stacking a non-transferable release layer, a protective layer, and an adhesive layer in that order from the sheet base material side. When the thermal transfer sheet is partially heated under pressure from the sheet base material side, a heated portion of the protective layer is transferred, together with the adhesive layer, as a protective laminate to printing paper.

In addition, a configuration in which solvent-insoluble organic fine particles are added to a protective layer has been proposed as a thermal transfer sheet capable of imparting excellent durability to ink images. The organic fine particles have an average particle diameter in a range of 0.05 μm to 1.0 μm and are added in a range of 150 to 2000 parts by weight relative to 100 parts by weight of a binder resin as a main component. As a result, the protective laminate transferred to an ink image and including the adhesive layer and the protective layer exhibits excellent film cutting property and an ink image covered with the protective laminated is imparted with excellent solvent resistance and durability (refer to Japanese Unexamined Patent Application Publication No. 11-105438).

SUMMARY OF THE INVENTION

However, when the thickness of the protective layer of the thermal transfer sheet with the above-described configuration is in a range of 1.0 μm or more, detachability at the interface between the non-transferable release layer and the protective layer is deteriorated, thereby causing surface roughness on the transferred protective layer. Such surface roughness of the protective layer after transfer causes deterioration in image quality of an ink image covered with the protective laminate.

It is desirable to provide a thermal transfer sheet and an ink ribbon each including a protective layer containing fine particles so that excellent solvent resistance and durability can be imparted to prints having ink images formed thereon, and excellent image quality can be achieved by improving detachability of the protective layer.

A thermal transfer sheet according to an embodiment of the present invention includes a protective layer and an adhesive layer which are laminated on a sheet base material in that order, the protective layer including a binder resin containing fine particles. In particular, the thermal transfer sheet has the feature that the particle diameter of the fine particles is 0.9 to 2.8 times the thickness of the protective layer.

An ink ribbon according to an embodiment of the present invention includes a protective region in which a protective layer having the above-described configuration and an adhesive layer are laminated, and a printing region including an ink layer, the protective region and the printing region being arranged in planar order on a sheet base material.

In the thermal transfer sheet and the ink ribbon having the above-described configurations, the particle diameter of the fine particles contained in the protective layer is defined to be 0.9 to 2.8 times the thickness of the protective layer, and thus detachability of the protective layer from the sheet base material side is secured, and surface roughness of the transferred protective layer is prevented. Therefore, as described below in examples, it was confirmed that good image quality is obtained.

As described above, a thermal transfer sheet according to an embodiment of the present invention includes a protective layer containing fine particles so that when the protective layer is transferred on a print in which an ink image is formed, excellent image quality may be achieved while imparting excellent solvent resistance and durability to the print.

DESCRIPTION OF THE PREFERRED EMBODIMENTS

Embodiments of the present invention are described in the order below on the basis of the drawings of the embodiments.

1. First embodiment (example of thermal transfer sheet including protective layer)

2. Second embodiment (example of ink ribbon including protective layer and ink region)

1. First Embodiment

Figure 1:
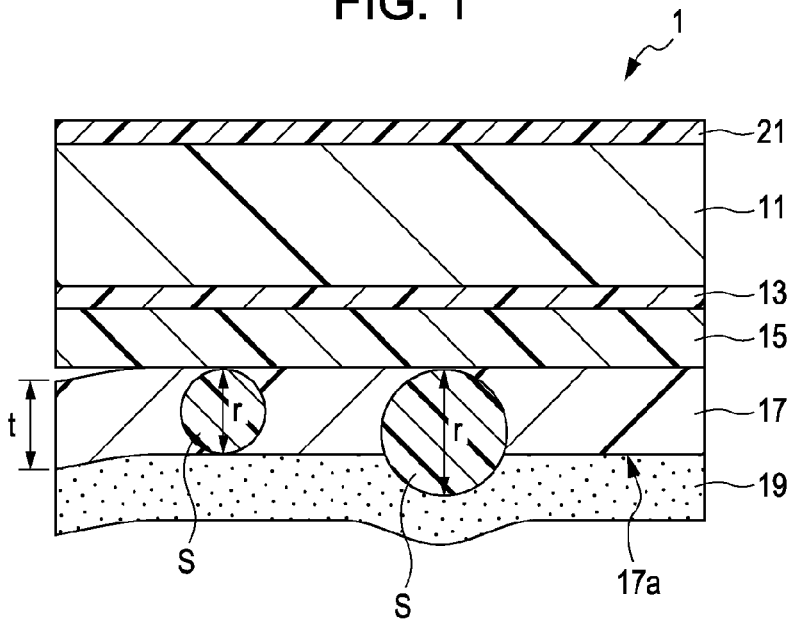
FIG. 1 is a schematic sectional view of a principal portion of a thermal transfer sheet according to an embodiment of the present invention.

FIG. 1 is a schematic sectional view showing a principal portion of a configuration example of a thermal transfer sheet 1 to which the present invention is applied. The thermal transfer sheet 1 according to an embodiment shown in FIG. 1 is used for covering (as a laminate) an ink image formed in a print and protecting it. The thermal transfer sheet 1 is configured as described below.

The thermal transfer sheet 1 includes a primer layer 13, a non-transferable release layer 15, a protective layer 17 including a binder resin 17*a* containing fine particles S, and an adhesive layer 19, which are laminated in that order on one of the main surfaces of a sheet base material 11. In addition, a heat-resistant slipping layer 21 is provided on the other main surface of the sheet base material 11. According to the first embodiment, the thermal transfer sheet 1 having such a layer configuration has the feature that the particle diameter r of the fine particles is 0.9 to 2.8 times the thickness t of the protective layer 17. Hereinafter, the detailed configuration of each of the layers including the protective layer 17 of the thermal transfer sheet 1 is described in order from the sheet base material 11.

<Sheet Base Material 11>

The sheet base material 11 supports various laminated coating films and resists heat energy of a thermal head and is thus composed of a material having heat resistance, mechanical strength, and dimensional stability. Further, the sheet base material 11 is preferably selected in view of feed stability and cost. As the sheet base material 11, the same material as that usually used for thermal transfer sheets and ink ribbons may be directly used, and other materials may be used. Preferred examples of the sheet base material 11 include widely-used plastic films such as a polyester film, a polyethylene film, a polypropylene film, and the like; and super engineering plastic films such as a polyimide film and the like.

In particular, the present invention is aimed at achieving a high glossy feel after thermal transfer of the protective layer 17, and thus a material having high surface smoothness is preferably selected and used as the sheet base material 11.

<Primer Layer 13>

The primer layer 13 is provided for improving adhesion between the sheet base material 11 and the non-transferable release layer 15. The primer layer 13 may be made of a urethane resin, an acrylic resin, a polyester resin, or the like.

An easily-adhesive layer composed of an acrylic resin, a polyester resin, or the like may be provided instead of the primer layer 13. The easily-adhesive layer is preferably provided to a uniform thickness on the sheet base material 11. The easily-adhesive layer having a uniform thickness may be formed by forming an easy-adhesive layer having a thickness of several μm before stretching of the sheet base material 11 and then biaxially stretching the sheet base material 11 so that the thickness of the easy-adhesive layer is 1 μm or less.

When the sheet base material 11 and the non-transferable release layer 15 have good adhesion therebetween, the primer layer 13 is not provided.

<Non-Transferable Release Layer 15>

The non-transferable release layer 15 is formed using a material selected from various heat-resistant resins. Examples of the heat-resistant resins include polyvinylacetoacetal resins and polyvinyl butyral resins, copolymers thereof, polyvinyl alcohol resins, acrylic resins, polyester resins, polyamide resins, polyamide-imide resins, polyether sulfone resins, polyether ether ketone resins, polysulfone resins, cellulose derivatives, and the like. Although the non-transferable release layer 15 composed of such a heat-resistant resin preferably has a thickness of about 1.0 μm, the thickness is not limited.

<Protective Layer 17>

The protective layer 17 is thermally transferred, by heat energy of a thermal head, to a surface of a print in which an ink image is formed, so as to be disposed in the outermost surface layer of the print after thermal transfer. The protective layer 17 is composed of the binder resin 17*a* and the fine particles S as a main component.

The binder resin 17*a* is composed of a thermoplastic resin. Examples of the thermoplastic resin include polystyrene resins, acrylic resins, polyester resins, and the like. By forming the protective layer 17 using such a resin as the binder resin 17*a*, functions such as friction resistance, chemical resistance, solvent resistance, and the like may be imparted to the protective layer 17.

The fine particles S are composed of a solvent-insoluble organic material. As the fine particles S, crosslinked polystyrene fine particles, crosslinked acryl fine particles, crosslinked polyester fine particles, or the like may be used. In addition, light resistance may be improved by adding an ultraviolet absorber. Examples of the ultraviolet absorber include salicylic acid derivatives, benzophenone derivatives, benzotriazole derivatives, oxalic anilide derivatives, and the like.

In particular, it is an important point that the particle diameter r of the fine particles S is 0.9 to 2.8 times the thickness t of the protective layer 17. The thickness t of the protective layer 17 is the thickness of a portion composed of only the binder resin 17*a* and is about 0.5 to 1.5 μm.

In the protective layer 17 containing the fine particles S dispersed in the binder resin 17*a*, it is a second important point that the ratio of the binder resin 17*a* to the fine particles S is 100 parts (parts by weight):0.5 to 20 parts (parts by weight). The ratio of the binder resin 17*a* to the fine particles S is more preferably 100 parts (parts by weight):2 to 20 parts (parts by weight).

It is also important to select the fine particles S having the same refractive index as that of the binder resin 17*a*. The expression "the same refractive index" represents that the refractive index is not limited to the same value and a difference in refractive index may be in a range of ±0.05 and is preferably as small as possible.

<Adhesive Layer 19>

The adhesive layer 19 is thermally transferred, together with the protective layer 17, to a surface of a print by heat energy of a thermal head and is disposed between the print and the protective layer 17 after thermal transfer. The adhesive layer 19 is composed of a thermoplastic resin, such as polyester, cellulose, vinyl chloride-vinyl acetate copolymer, urethane, ethylene-vinyl acetate copolymer, or the like. In order to enhance adhesion to the print, it is desired to design the adhesive layer 19 having a relatively low glass transition temperature Tg, and the glass transition temperature Tg is preferably about 40° C. to 100° C. At the same time, it is desired to confirm that various image storage properties (heat resistance, light resistance, dark storage stability, and the like) are good.

In addition, the adhesive layer 19 has a thickness of about 0.5 to 1.5 μm and is provided to cover the fine particles S projecting from the binder resin 17*a* of the protective layer 17, i.e., completely cover the entire surface of the protective layer 17.

<Heat-Resistant Slipping Layer 21>

The heat-resistant slipping layer 21 is provided for the purpose of preventing heat fusion bonding between the thermal head of a thermal transfer printer and the thermal transfer sheet 1, achieving smooth running of the thermal head, and removing the substances adhering to the thermal head. The heat-resistant slipping layer 21 is composed of a heat-resistant resin such as cellulose acetate, polyvinyl acetoacetal resin, polyvinyl butyral resin, or the like. In addition, in the heat-resistant slipping layer 21, the friction coefficient with the thermal head is preferably kept substantially constant regardless of during heating or non-heating. Therefore, according to demand, a lubricant such as silicone oil, wax, fatty acid ester, phosphate ester, or the like, and an organic or inorganic filler may be added to the heat-resistant slipping layer 21. When the sheet base material 11 has good heat resistant and slipping property, the heat-resistant slipping layer 21 is not necessarily provided.

<Method for Producing Thermal Transfer Sheet>

The thermal transfer sheet having the above-described configuration is produced by forming the layers in order on the sheet base material 11. In this case, a step of applying a coating solution containing a resin material and the like, which constitute each of the layers, by any one of various application methods such as gravure coating, gravure reverse coating, roll coating, and the like, and then drying the resultant coating is repeated for the layers.

In the thermal transfer sheet 1 configured as described above, the particle diameter r of the fine particles S contained in the protective layer 17 is defined to be 0.9 to 2.8 times the thickness t of the protective layer 17, thereby securing detachability of the protective layer 17 from the sheet base material 11 and preventing surface roughness of the transferred protective layer 17. Therefore, as described in examples below, it was confirmed that good image quality is attained. As a result, when the protective layer 17 is transferred to a print in which an ink image is formed, good solvent resistance and durability may be imparted to the print, and good quality may be imparted by improving detachability of the protective layer 17.

2. Second Embodiment

Figure 2:
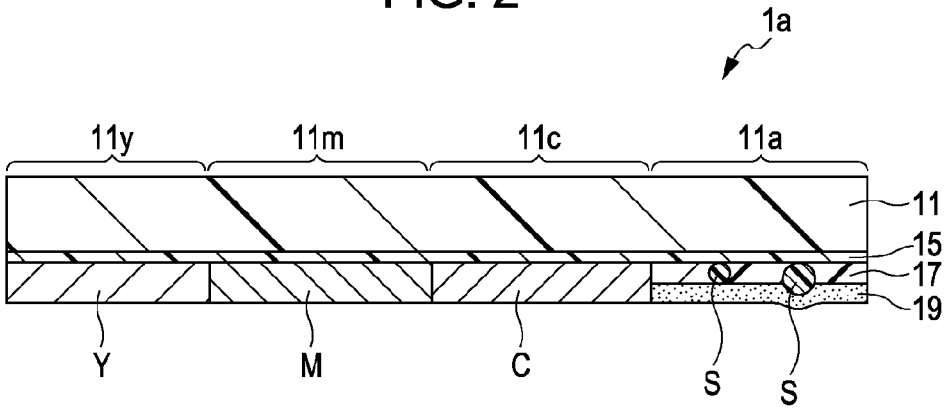
FIG. 2 is a schematic sectional view of a principal portion of an ink ribbon according to an embodiment of the present invention.

FIG. 2 is a schematic sectional view showing a principal portion of a configuration example of an ink ribbon 1*a* to which the present invention is applied. In FIG. 2, the same components as in the first embodiment are denoted by the same reference numerals.

The ink ribbon 1*a* according to an embodiment shown in FIG. 2 includes a protective region 11*a* in which the protective layer 17 described in the first embodiment is provided, and printing regions 11*c*, 11*m*, and 11*y* including ink layers C, M, Y, respectively, the protective region 11*a* and the printing regions 11*c*, 11*m*, and 11*y* being arranged in planar order in a direction on a sheet base material 11. The configuration of the protective region 11*a* is the same as that of the thermal transfer sheet described in the first embodiment. The cyan printing region 11*c*, the magenta printing region 11*m*, and the yellow printing region 11*y* are provided with a cyan ink layer C, a magenta ink layer M, and a yellow ink layer Y, respectively. In addition, sensor marks (not shown) are provided between the respective regions 11*a*, 11*c*, 11*m*, and 11*y*.

Each of the ink layers C, M, and Y provided in the printing regions 11*c*, 11*m*, and 11*y*, respectively, is composed of a color dye dispersed or dissolved in a binder resin. As the binder resin, various resins may be used. Examples of such resins include cellulose resins, such as methyl cellulose, ethyl cellulose, ethylhydroxyethyl cellulose, hydroxypropyl cellulose, cellulose acetate butyrate, cellulose acetate, and the like; vinyl resins, such as polyvinyl alcohol, polyvinyl butyral, polyvinyl acetoacetal, polyvinyl acetate, polystyrene, and the like; polyester resins; acrylic resins; urethane resins, and the like.

A material used as the color dye satisfies the conditions in which it easily sublimates/thermally diffuses without thermal decomposition within the heat energy range of the thermal head, it is stable to heat, light, temperature, and chemicals and excellent in image storage property, it has a desired absorption wave band, and it is hardly recrystallized in an ink layer. Also, a material easy to synthesize is preferred.

A mixture of a plurality of dyes is often used as such a color dye, and the color dye preferably has heat transfer ability. Namely, the color dye preferably thermally diffuses from an ink layer in color dye molecular units. The color dye is not particularly limited, and any color dye which is used for a usual thermal transfer system may be effectively used as the color dye in the present invention.

Examples of a cyan dye include anthraquinone dyes, naphthoquinone dyes, heterocyclic azo dyes, indoaniline dyes, and mixtures thereof. Examples of a magenta dye include azo dyes, anthraquinone dyes, styryl dyes, heterocyclic azo dyes, and mixtures thereof. Examples of a yellow dye include azo dyes, disazo dyes, methine dyes, styryl dyes, pyridone azo dyes, and mixtures thereof.

The configuration between the sheet base material 11 and the ink layers C, M, and Y in the printing regions 11*c*, 11*m*, and 11*y*, respectively, may be the same as that between the protective layer 17 and the sheet base material 11 in the protective region 11*a*.

In thermal transfer printing with a thermal transfer printer using the above-described ink ribbon 1*a*, an ink image is formed by thermally transferring, to the printing sheet side, the ink layers C, M, and Y in the printing regions 11*c*, 11*m*, and 11*y*, respectively, with the thermal head of the thermal transfer printer. Then, the protective layer 17 and the adhesive layer 19 are thermally transferred onto the printing sheet, on which the ink image is formed, with the thermal head of the thermal transfer printer.

By using the above-described ink ribbon 1*a*, the ink image formed by transferring the ink layers C, M, and Y in the printing regions 11*c*, 11*m*, and 11*y*, respectively, is covered with the protective layer 17 transferred from the protective region 11*a*. Since the protective layer 17 has the same configuration as in the first embodiment, the protective layer 17 is transferred onto the ink image with good detachability without causing surface roughness. As a result, it may be possible to transfer, with good detachability, the protective layer 17 on the print in which the ink image is formed and to form the print of excellent image quality while imparting solvent resistance and durability.

EXAMPLES

Next, examples of the present invention and comparative examples and the evaluation results thereof are described.

Examples 1 to 4 and Comparative Example 1

TABLE 1

| | Material | Refractive index | Comparative Example 1 | Example 1 | Example 2 | Example 3 | Example 4 |
|---|---|---|---|---|---|---|---|
| Non-transferable release layer 15 | Polyvinyl acetal resin | — | | | 10 parts | | |
| | Methyl ethyl ketone | — | | | 45 parts | | |
| | Toluene | — | | | 45 parts | | |
| Protective layer 17 | Polystyrene (binder resin) | 1.59 | | | 10 parts | | |
| | Cross-linked polystyrene fine particle | 1.59 | — | 0.05 part | 0.5 part | 2 parts | 3 parts |
| | Toluene | — | 90 parts | 89.95 parts | 89.5 parts | 88 parts | 87 parts |
| Adhesive layer 19 | Acrylic resin | 1.49 | | | 10 parts | | |
| | Methyl ethyl | — | | | 45 parts | | |

TABLE 1-continued

| Material | Refractive index | Comparative Example 1 | Example 1 | Example 2 | Example 3 | Example 4 |
|---|---|---|---|---|---|---|
| ketone | | | | | | |
| Toluene | — | | | 45 parts | | |
| Evaluation of detachability | | Poor | Nearly good | Good | Good | Good |

A non-transferable release layer shown in Table 1 was formed to one of the surfaces of a polyester film base material of 4.5 μm (K604E4.5W manufactured by Mitsubishi Chemical Polyester Film Co., Ltd.) so that the dry thickness was about 1.0 μm and then dried (90° C., 1 minute) to form the non-transferable release layer of a thermal transfer laminate film.

Next, a protective layer 17 was formed. In this case, coating solutions containing the materials shown in Table 1 were prepared by changing the mixing amount of the fine particles S composed of crosslinked polystyrene for each of Examples 1 to 4. The fine particles used had an average particle diameter of 1.0 to 2.0 μm. In Comparative Example 1, a coating solution was prepared without mixing the fine particles S. Each of the coating solutions was applied so that the dry thickness of the binder resin 17*a* (polystyrene) was 0.7 to 1.1 μm and then dried (90° C., 1 minute) to form the protective layer 17. The expression "average particle diameter of 1.0 to 2.0 μm" represents that fine particles having particle diameters within a range of 1.0 to 2.0 μm are contained. The same applies hereinafter.

As a result, in each Examples 1 to 4, the particle diameter r (1.0 to 2.0 μm) of the fine particles S in the protective layer 17 was 0.9 to 2.8 times the thickness t (0.7 to 1.1 μm) of the protective layer 17 and thus within the range of the present invention. However, in Comparative Example 1, the protective layer did not contain the fine particles S and was thus out of the range of the present invention.

Next, an adhesive layer 19 was formed. In this case, a coating solution containing the materials shown in Table 1 was applied so that the dry thickness was about 1.0 μm and then dried (100° C., 1 minute) to form the adhesive layer 19.

As a result, a thermal transfer sheet 1 of each of Examples 1 to 4 and Comparative Example 1 was prepared by laminating the non-transferable release layer 15, the protective layer 17, and the adhesive layer 19 in that order on the sheet base material 11.

Evaluation 1

White solid printing was performed on genuine printing paper for UP-DR150 manufactured by Sony Corporation with UP-DR150 printer manufactured by Sony Corporation using the thermal transfer sheet 1 of each of Examples 1 to 4 and Comparative Example 1. The detachability of the protective layer was visually evaluated from each of the resultant prints. The results are also shown in Table 1. In evaluation of detachability, when the protective layer was transferred to a receiving layer of the printing paper, and the base material film and the non-transferable release layer were separated without problem, detachability was evaluated as "Good". On the other hand, when there occurred a phenomenon that peeling of the base material film and the non-transferable release layer was partially impaired, causing a fusion-bonded portion, detachability was evaluated as "Poor". In a case intermediate between the two, detachability was evaluated as "Nearly good".

These results indicate that in Examples 1 to 4 each using the protective layer 17 having the configuration of the present invention, detachability of the protective layer 17 is good or nearly good, while in Comparative Example 1 using the protective layer having a configuration different from that of the present invention, detachability is poor. Therefore, it was confirmed that good detachability is achieved by adding the fine particles S having a particle diameter r within the range of the present invention relative to the thickness t of the protective layer 17.

Examples 5 to 8 and Comparative Example 2

TABLE 2

| | Material | Refractive index | Comparative Example 2 | Example 5 | Example 6 | Example 7 | Example 8 |
|---|---|---|---|---|---|---|---|
| Non-transferable release layer 15 | Polyester resin | — | | | 10 parts | | |
| | Methyl ethyl ketone | — | | | 45 parts | | |
| | Toluene | — | | | 45 parts | | |
| Protective layer 17 | PMMA (binder resin) | 1.49 | | | 10 parts | | |
| | Cross-linked PMMA fine particle | 1.49 | — | 0.05 part | 0.5 part | 2 parts | 3 parts |
| | Toluene | — | 90 parts | 89.95 parts | 89.5 parts | 88 parts | 87 parts |
| Adhesive layer 19 | Acrylic resin | 1.49 | | | 10 parts | | |
| | Methyl ethyl ketone | — | | | 45 parts | | |
| | Toluene | — | | | 45 parts | | |
| Evaluation of detachability | | | Poor | Nearly good | Good | Good | Good |

A non-transferable release layer shown in Table 2 was applied to one of the surfaces of a polyester film base material of 4.5 μm (K604E4.5W manufactured by Mitsubishi Chemical Polyester Film Co., Ltd.) so that the dry thickness was about 1.0 μm and then dried (90° C., 1 minute) to form the non-transferable release layer of a thermal transfer laminate film.

Next, a protective layer 17 was formed. In this case, coating solutions containing the materials shown in Table 2 were prepared by changing the mixing amount of the fine particles S composed of crosslinked PMMA for each of Examples 5 to 8. The fine particles used had an average particle diameter of 1.0 to 2.0 μm. In Comparative Example 2, a coating solution was prepared without mixing the fine particles S. Each of the coating solutions was applied so that the dry thickness of the binder resin 17*a* (PMMA) was 0.7 to 1.1 μm and then dried (90° C., 1 minute) to form the protective layer 17.

As a result, in each of Examples 5 to 8, the particle diameter r (1.0 to 2.0 μm) of the fine particles in the protective layer 17 was 0.9 to 2.8 times the thickness t (0.7 to 1.1 μm) of the protective layer 17 and was thus within the range of the present invention. However, in Comparative Example 2, the protective layer did not contain the fine particles S and was out of the range of the present invention.

Next, an adhesive layer 19 was formed. In this case, a coating solution containing the materials shown in Table 2 was applied so that the dry thickness was about 1.0 μm and then dried (100° C., 1 minute) to form the adhesive layer 19.

As a result, a thermal transfer sheet 1 of each of Examples 5 to 8 and Comparative Example 2 was prepared by laminating the non-transferable release layer 15, the protective layer 17, and the adhesive layer 19 in order on the sheet base material 11.

Evaluation 2

White solid printing was performed on genuine printing paper for UP-DR150 manufactured by Sony Corporation with UP-DR150 printer manufactured by Sony Corporation using the thermal transfer sheet 1 of each of Examples 5 to 8 and Comparative Example 2. The detachability of the image protective layer was visually evaluated from each of the resultant prints. The results are also shown in Table 2.

These results indicate that in Examples 5 to 8 each using the protective layer 17 having the configuration of the present invention, detachability of the protective layer 17 is good or nearly good, while in Comparative Example 2 using the protective layer having a configuration different from that of the present invention, detachability is poor. Therefore, it was confirmed that good detachability is achieved by adding the fine particles S having a particle diameter r within the range of the present invention relative to the thickness t of the protective layer 17.

Example 9 and Comparative Example 3

TABLE 3

| | Material | Average particle diameter | Refractive index | Comparative Example 3 | Example 9 |
|---|---|---|---|---|---|
| Non-transferable release layer 15 | Polyester resin | — | — | 10 parts | |
| | Methyl ethyl ketone | — | — | 45 parts | |
| | Toluene | — | — | 45 parts | |
| Protective layer 17 | PMMA (binder resin) | — | 1.49 | 10 parts | |
| | Cross-linked | 0.5 to 1.0 | 1.49 | 0.2 part | — |
| | PMMA fine particle | 1.0 to 2.0 | | — | 0.2 part |
| | Toluene | — | — | 89.8 parts | 89.8 parts |
| Adhesive layer 19 | Acrylic resin | — | 1.49 | 10 parts | |
| | Methyl ethyl ketone | — | — | 45 parts | |
| | Toluene | — | — | 45 parts | |
| Evaluation of detachability | | | | Nearly good | Good |
| Evaluation of glossy feel | | | | Good | Good |

A non-transferable release layer 15 was formed on one of the surfaces of a sheet base material 11 including a polyester film of 4.5 μm (K604E4.5W manufactured by Mitsubishi Chemical Polyester Film Co., Ltd.). In this case, a coating solution containing the materials shown in Table 3 was applied so that the dry thickness was about 1.0 μm and then dried (90° C., 1 minute) to form the non-transferable release layer 15.

Next, a protective layer 17 was formed. In this case, in Example 9 and Comparative Example 3, coating solutions were prepared using fine particles S having different average particle diameters as shown in Table 3. Each of the coating solutions was applied so that the dry thickness of the binder resin 17*a* (PMMA) was 0.7 to 1.1 μm and then dried (90° C., 1 minute) to form the protective layer 17.

As a result, in Example 9, the particle diameter r (1.0 to 2.0 μm) of the fine particles S was 0.9 to 2.8 times the thickness t (0.7 to 1.1 μm) of the protective layer 17 and thus the configuration of the protective layer 17 was in the range of the present invention. However, in Comparative Example 3, the particle diameter r (0.5 to 1.0 μm) of the fine particles S was 0.45 to 1.48 times the thickness t (0.7 to 1.1 μm) of the protective layer 17 and thus the configuration of the protective layer 17 was out of the range of the present invention.

Next, an adhesive layer 19 was formed. In this case, a coating solution containing the materials shown in Table 3 was applied so that the dry thickness was about 1.0 μm and then dried (100° C., 1 minute) to form the adhesive layer 19.

As a result, a thermal transfer sheet 1 of each of Example 9 and Comparative Example 3 was prepared by laminating the non-transferable release layer 15, the protective layer 17, and the adhesive layer 19 in that order on the sheet base material 11.

Evaluation 3

White solid printing was performed on genuine printing paper for UP-DR150 manufactured by Sony Corporation with UP-DR150 printer manufactured by Sony Corporation using the thermal transfer sheet 1 of each of Example 9 and Comparative Example 3. The detachability of the image protective layer and a glossy feel were visually evaluated from each of the resultant prints. The results are also shown in Table 3. The glossy feel was visually evaluated by visually determining the definition of the image when a light of a white fluorescent lamp was reflected off the white solid print.

These results indicate that in Example 9 using the protective layer 17 having the configuration of the present invention, detachability of the protective layer 17 is good or nearly good, while in Comparative Example 3 using the protective layer having a configuration different from that of the present invention, detachability is inferior to Example 9. Therefore, it was confirmed that good detachability of the protective layer 17 is achieved by defining the particle diameter r of the fine particles S relative to the thickness t of the protective layer 17. In addition, both Example 9 and Comparative Example 3 show a good glossy feel regardless of detachability. Therefore, it was confirmed that in Example 9 according to the present invention, both a good glossy feel and detachability of the protective film 17 are achieved, thereby causing good image quality. In Comparative Example 3, the average particle diameter of organic fine particles is 0.5 to 1.0 μm, but there is no factor that degrades a glossy feel. However, the average particle diameter r of the organic fine particles relative to the thickness t (0.7 to 1.1 μm) of the protective layer 17 is out of the range of the present invention, thereby causing poor detachability and thus decreasing image quality due to surface roughness.

Examples 10 to 18

A non-transferable release layer 15 was formed on one of the surfaces of a sheet base material 11 including a polyester film of 4.5 μm (K604E4.5W manufactured by Mitsubishi Chemical Polyester Film Co., Ltd.). In this case, a coating solution containing the materials shown in Table 4 was applied so that the dry thickness was about 1.0 μm and then dried (90° C., 1 minute) to form the non-transferable release layer 15.

Next, a protective layer 17 was formed. In this case, coating solutions were prepared by changing the mixing amount of fine particles S composed of a material with each of the refractive indexes shown in Table 4. The fine particles S used had an average particle diameter of 1.0 to 2.0 μm. Each of the coating solutions was applied so that the dry thickness of the binder resin 17*a* (PMMA) was 0.7 to 1.1 μm and then dried (90° C., 1 minute) to form the protective layer 17.

As a result, in each of Examples 10 to 18, the particle diameter r (1.0 to 2.0 μm) of the fine particles S was 0.9 to 2.8 times the thickness t (0.7 to 1.1 μm) of the protective layer 17 and thus within the range of the present invention.

Next, an adhesive layer 19 was formed. In this case, a coating solution containing the materials shown in Table 4 was applied so that the dry thickness was about 1.0 μm and then dried (100° C., 1 minute) to form the adhesive layer 19.

As a result, a thermal transfer sheet 1 of each of Examples 10 to 18 was prepared by laminating the non-transferable release layer 15, the protective layer 17, and the adhesive layer 19 in that order on the sheet base material 11.

Evaluation 4

White solid printing was performed on genuine printing paper for UP-DR150 manufactured by Sony Corporation with UP-DR150 printer manufactured by Sony Corporation using the thermal transfer sheet 1 of each of Examples 10 to 18. The detachability of the protective layer and a glossy feel were visually evaluated from each of the resultant prints. The results are also shown in Table 4.

These results indicate that in Examples 10 to 18 each using the protective layer 17 having the configuration of the present invention, detachability of the protective layer 17 is good. However, in Examples 13 to 18 having a difference of over+

TABLE 4

| | Material | Refractive index | Example 10 | Example 11 | Example 12 | Example 13 | Example 14 | Example 15 | Example 16 | Example 17 | Example 18 |
|---|---|---|---|---|---|---|---|---|---|---|---|
| Non-transferable release layer 15 | Polyester resin | — | | | | | 10 parts | | | | |
| | Methyl ethyl ketone | — | | | | | 45 parts | | | | |
| | Toluene | — | | | | | 45 parts | | | | |
| Protective layer 17 | PMMA | 1.49 | | | | | 10 parts | | | | |
| | Cross-linked PMMA fine particle | 1.49 | 0.2 part | 2 parts | 3 parts | — | — | — | — | — | — |
| | Silicone fine particle | 1.43 | — | — | — | 0.2 part | 2 parts | 3 parts | — | — | — |
| | Crosslinked polystyrene fine particle | 1.59 | — | — | — | — | — | — | 0.2 part | 2 parts | 3 parts |
| | Toluene | — | 89.8 parts | 88 parts | 87 parts | 89.8 parts | 88 parts | 87 parts | 89.8 parts | 88 parts | 87 parts |
| Adhesive layer 19 | Acrylic resin | 1.49 | | | | | 10 parts | | | | |
| | Methyl ethyl ketone | — | | | | | 45 parts | | | | |
| | Toluene | — | | | | | 45 parts | | | | |
| Evaluation of detachability | | | Good | Good | Good | Good | Good | Good | Good | Good | Good |
| Evaluation of glossy feel | | | Good | Good | Nearly good | Nearly good | Poor | Poor | Nearly good | Poor | Poor |

0.05 in refractive index between the binder resin 17*a* and the fine particles S constituting the protective layer 17, detachability is good, but a glossy feel is deteriorated by the influence of light scattering due to a large difference in refractive index.

Also, the evaluation results of detachability of Examples 1 to 8 shown in Tables 1 and 2 confirmed that when the particle diameter r of the fine particles S is within the range of the present invention, i.e., 0.9 to 2.8 times the thickness t of the protective layer 17, detachability is good or nearly good with 0.5 part of the fine particles relative to 100 parts of the binder resin. Further, the evaluation results of glossy feel of Examples 10 to 12 shown in Table 4 confirmed that when the amount of the fine particles is 20 parts or less relative to 100 parts of the binder resin, a glossy feel is maintained good by suppressing the influence of light scattering at the interfaces of the fine particles.

The present application contains subject matter related to that disclosed in Japanese Priority Patent Application JP 2009-118163 filed in the Japan Patent Office on May 15, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal transfer sheet comprising:

a protective layer and an adhesive layer that are laminated on a sheet base material in that order, the protective layer including a binder resin containing fine particles, wherein, a particle diameter of each of the fine particles is only within a range of 0.9 to 2.8 times a thickness of the protective layer, and the thickness of the protective layer is equal to a thickness of a binder resin excluding the fine particles.

2. The thermal transfer sheet according to claim 1, wherein the protective layer contains 0.5 to 20 parts of the fine particles relative to 100 parts of the binder resin.

3. The thermal transfer sheet according to any one of claims 1 to 2, wherein the binder resin and the fine particles have the same refractive index.

4. The thermal transfer sheet according to any one of claims 1 to 2, wherein of the fine particles, fine particles having a particle diameter larger than the thickness of the protective layer are covered with the adhesive layer.

5. The thermal transfer sheet according to claim 1, wherein:

the binder resin and the fine particles have the same refractive index, and of the fine particles, fine particles having a particle diameter larger than the thickness of the protective layer are covered with the adhesive layer.

* * * * *